United States Patent [19]

Blanc

[11] 4,143,491

[45] Mar. 13, 1979

[54] APPARATUS FOR AGITATING AND POLISHING MATERIALS

[75] Inventor: Yale A. Blanc, Glencoe, Ill.

[73] Assignee: Martin Yale Industries, Inc., Chicago, Ill.

[21] Appl. No.: 839,197

[22] Filed: Oct. 4, 1977

[51] Int. Cl.[2] ..... B24B 31/06

[52] U.S. Cl. ..... 51/163.1

[58] Field of Search ..... 51/7, 163.1

[56] References Cited

U.S. PATENT DOCUMENTS

| | | | |
|---|---|---|---|
| 2,923,100 | 2/1960 | Simjian | 51/7 |
| 3,267,620 | 8/1966 | Dayton | 51/163.1 |
| 3,341,978 | 9/1967 | Carstens | 51/163.1 |
| 3,978,623 | 9/1976 | Smith | 51/163.1 |

*Primary Examiner*—Harold D. Whitehead

*Attorney, Agent, or Firm*—Vogel, Dithmar, Stotland, Stratman & Levy

[57] ABSTRACT

A vibratory polishing machine for minerals, gem stones and the like in which a carriage is resiliently mounted to a base and is provided with a motor fixedly mounted to the carriage. The motor output shaft is eccentrically connected via a crank to a drum supported on the carriage. Activation of the motor vibrates one end of the drum while the other end of the drum pivotally mounted on the carriage remains relatively stationary. The drum vibration causes materials inside the drum to rotate continuously in a circular path providing a polishing action.

8 Claims, 5 Drawing Figures

FIG. 1
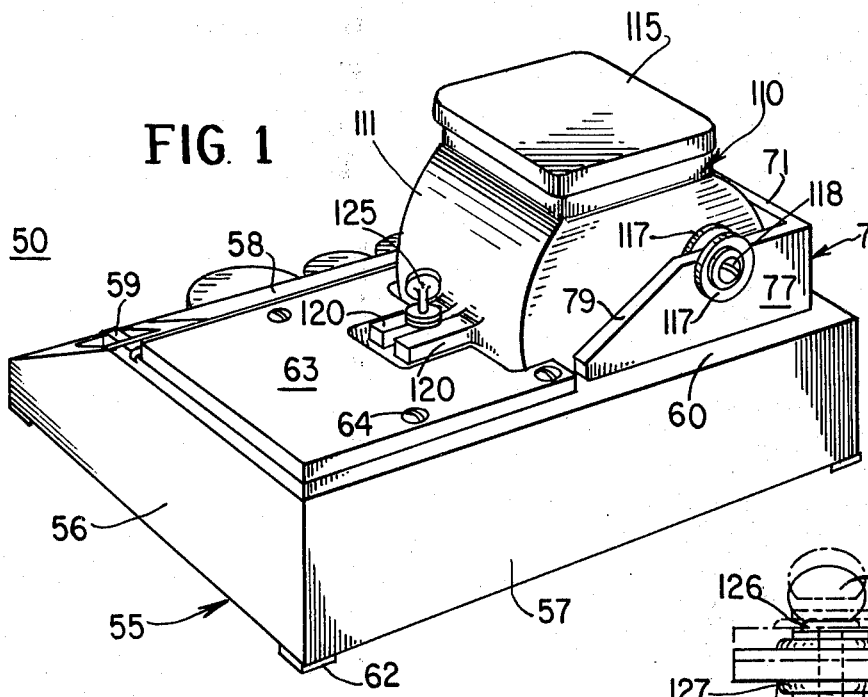
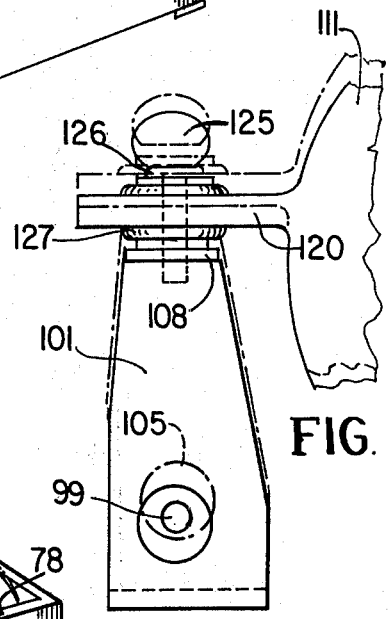
FIG. 5
FIG. 2
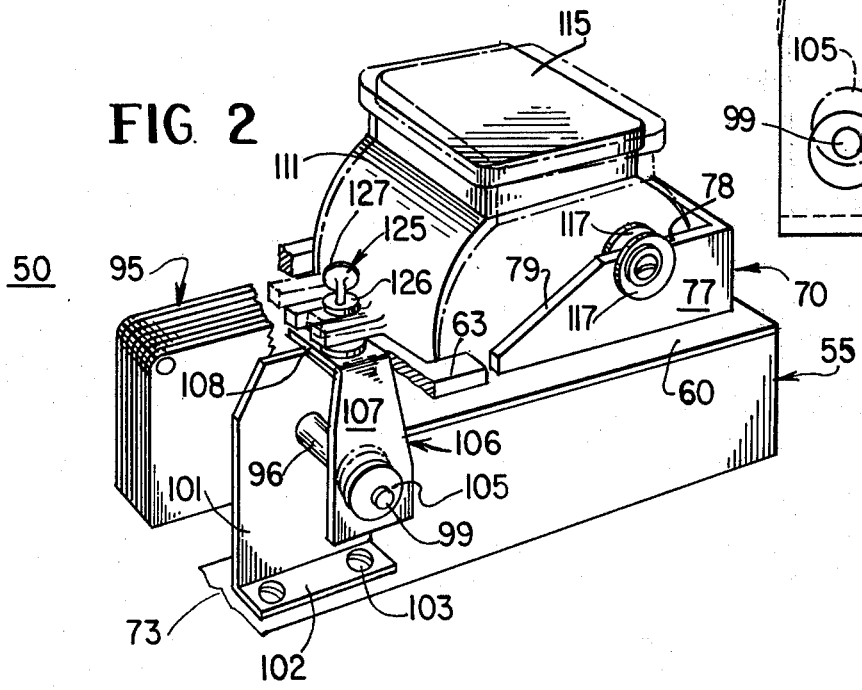

APPARATUS FOR AGITATING AND POLISHING MATERIALS

BACKGROUND OF THE INVENTION

In the past, a number of devices or machines have been constructed for rotating or tumbling stones, minerals and other rough irregular objects in the presence of an abrasive compound and substance, which action, when continued over extended periods of time, completely removes all irregularities and imparts a high finish to the material being processed. One of the disadvantages in the previous devices have been the length of time required in order to finish and polish a load, since it is obvious that hard materials such as gem stones and minerals require long periods of tumbling action in the presence of abrasives to accomplish this desired result. Furthermore, many of the previous devices have not thoroughly mixed and agitated the load with the result that certain parts of the load or charge are polished at the end of a treatment period, whereas other parts of the load or charge which have not received the full agitating or vibrating effect are not in satisfactory condition and polishing treatments must be continued.

Illustrative of the prior devices is that described in U.S. Pat. No. 3,197,922 issued to Edward Earl Smith, Aug. 3, 1965. The Smith device is an expensive, rather complicated device which depends on a drum supported on a platform which is spring loaded to a base. The length of the lever arm between the center of the drum and each of the springs must be precisely set and be uneven in order to provide an oscillating or tumbling motion to the motor charge within the drum. A complicated pulley and crank shaft device is utilized to provide the rotating and oscillating movement.

It has been found that the polishing and finishing time, when using the device according to the present invention, is reduced marketly from a period of weeks to continuous polishing required in previous devices down to a matter of hours or a few days in the case of the present invention, and particularly, the present invention is an improvement over the Smith device.

SUMMARY OF THE INVENTION

This invention relates to a machine or apparatus for the finishing or polishing of materials and gem stones, and more particularly to a device producing orbital vibration and tumbling action wherein one end of the device is pivotally mounted to the carriage and the other end of the device is connected to a crank eccentrically mounted to the output shaft of a motor.

It is an important object of the present invention to provide an inexpensive yet superior machine for polishing minerals, gem stones and the like in which the drum holding the load or charge is pivotally mounted at one end thereof and is vibrated vertically at the other end thereof.

A principal object of the present invention is to provide a vibratory polishing machine for minerals, gem stones and the like comprising a base, a carriage resiliently mounted within said base, a motor fixedly mounted on said carriage and having an output shaft extending therefrom, a drum mounted directly to said carriage near one end of said drum, and means eccentrically mounted to said output shaft connecting the other end of said drum to said output shaft, whereby actuation of said motor causes said output shaft to rotate and said other end of said drum to vibrate vertically while the one end of said drum remains substantially stationary, the rapid reciprocating vertical movement of said other end of said drum causing minerals, gem stones or the like in said drum to move upwardly along the wall at the one end and then to fall inwardly toward the middle of said drum providing a polishing action.

These and other objects of the present invention will be more readily understood when taken in conjunction with the following specification and drawings, in which:

BRIEF DESCRIPTION OF THE DRAWINGS

FIG. 1 is a perspective view of the vibratory polishing machine of the present invention;

FIG. 2 is a perspective view of a portion of the device illustrated in FIG. 1 with the cover and base partly removed to illustrate the position of the motor and the drum;

FIG. 5 is an enlarged side elevational view of the connection between the drum and crank connected to the motor output shaft.

DESCRIPTION OF THE PREFERRED EMBODIMENT

Figure 3:
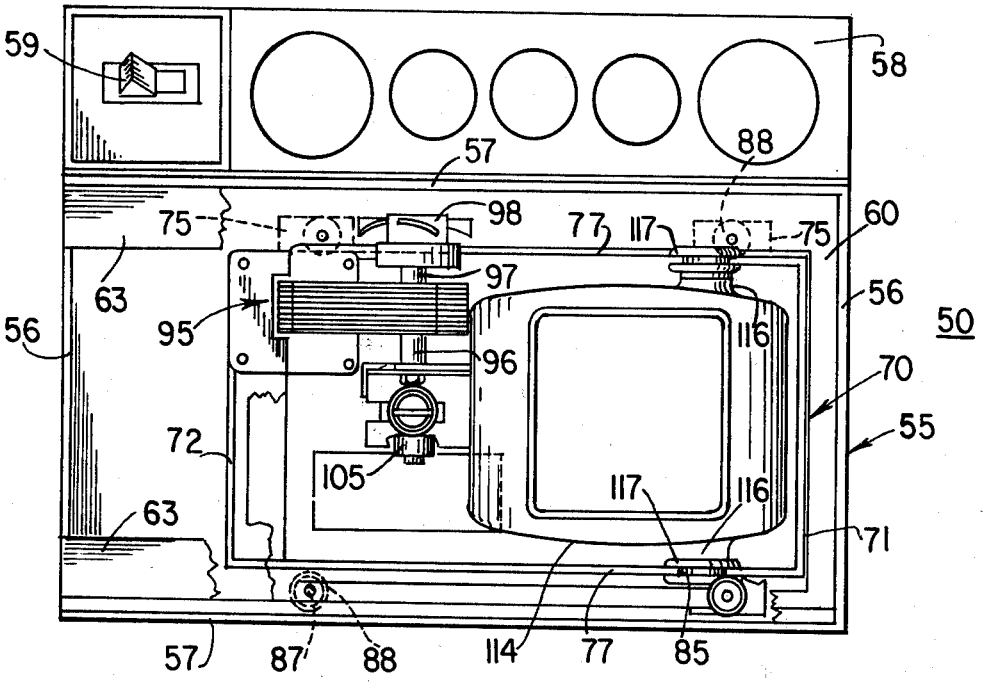
FIG. 3 is a top plan view of the device illustrated in FIG. 1 with the cover plate removed to illustrate the location of the motor and the drum.
Figure 4:
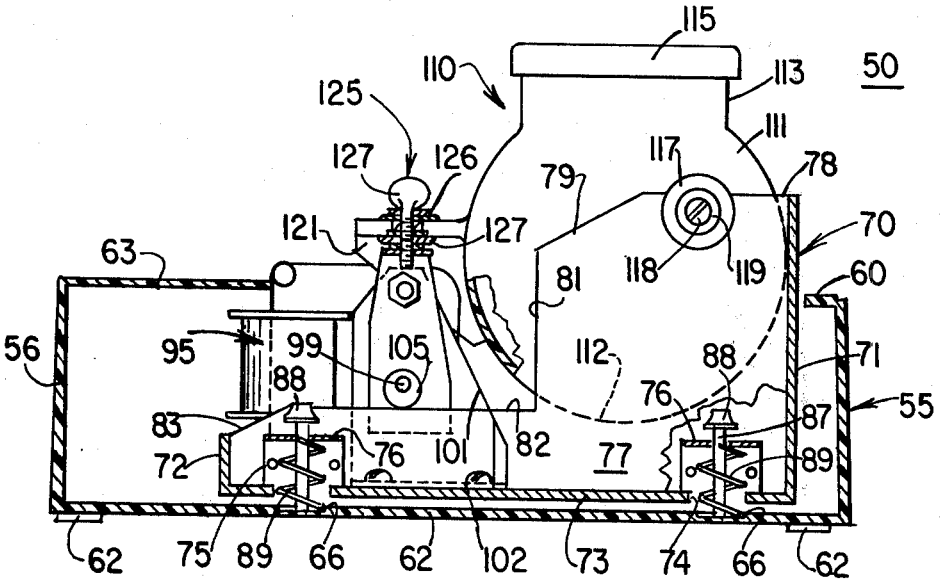
FIG. 4 is a side elevational view of the device illustrated in FIG. 1 partly in section illustrating the position of the carriage and base.

Referring now to the drawings, and particularly to FIGS. 1, 3 and 4, there is disclosed the agitating and polishing device 50 including a rectangular base 55 comprised of spaced apart upstanding side walls 56 interconnected by a back wall 57 and a downwardly sloping front wall 58 having an off-on switch 59 of the usual type. Other controls may also be located on the front wall 58 or the front wall may be used for decorative purposes. The base 55 may be made of any satisfactory material such as metal or a synthetic organic resin.

An inwardly extending top wall 60 forms a lip around substantially the entire periphery of the rectangular opening formed by the spaced apart end walls 56, the back wall 57 and the downwardly sloping front wall 58. A bottom 61 is provided and while not necessarily completely closed extends sufficiently inwardly from the end walls 56, the rear wall 57 and the front wall 58 to form a platform containing four spaced apart wells 66, for a purpose hereinafter set forth. Four feet 62 are provided at the corners of the base 55 and a cover plate 63 having a generally irregular Y-shaped cutout at one end thereof is secured to the lip 60 by means of fasteners 64.

A carriage 70, generally rectangular in plan view, is open at the top thereof and fits within the base 55 and particularly between the lip or top 60 and the left-hand end wall 56 as seen in FIG. 3. The carriage 70 includes spaced apart and parallel end walls 71 and 72 interconnected by a bottom 73 having four spaced apart apertures 74 therein, the apertures 74 being in registry with the wells 66 when the carriage 70 is properly positioned in the base 55. Four spring housings 75 are positioned over the apertures 74 with each spring housing including an apertured top 76.

Side walls 77 interconnect the carriage 70, end walls 71 and 72 and each of the side walls is irregularly shaped, having an edge 78 extending horizontally from the end wall 71 toward the end wall 72, it being understood that the side walls 77 are identical in shape and the description of one side wall pertains to the other side wall. At the end of the horizontal portion 78 there is a downwardly slanting portion 79 which terminates in a vertically extending edge 81. A horizontally extending edge 82 interconnects the end of the vertical portion 81 and a downwardly sloping portion 83 which intersects the other end wall 72 to complete the irregularly shaped edge of each side wall 77. Each of the side walls 77 is provided with a notch in the horizontal portions 78, which notches are in registry with each other and near the end wall 71. Finally, the carriage 70 is spring mounted to the base 65 by means of four posts 87 extending upwardly from the wells 66 in the base 55, each post passing through the aperture in the top 76 and having a cap 88 thereon. A coil spring 89 surrounds the post 87 and is trapped between the wells 66 in the bottom 62 of the base 55 and the apertured tops 76 in spring housings 75 of the carriage 70, thereby to mount the carriage to the base.

A motor 95 is mounted to the bottom 73 of carriage 70 and has an output shaft 96 having one end 97 thereof provided with a fan 98 and the other end 99 thereof extending outwardly toward the back wall 57 of the base 55. The fan 98 is positioned in the space between the juncture of the sloping front wall 58 and the lip or top 60 and the adjacent side wall 77 of the carriage 70, the fan serving to cool the motor 95 during operation thereof. Mounted to the carriage bottom 73 near the other end of the output shaft 96, is a mounting bracket 101 which has a horizontally positioned flange 102 secured by fasteners 103 to the carriage bottom 73. The bracket 101 has an aperture therein through which extends the motor output shaft 96. Fixedly secured to the end 99 of the output shaft 96 are a pair of spaced apart collars 105 circular in plan view and mounted eccentrically, as best seen in FIG. 5. A crank 106 is fixedly secured between the collars 105 and has a vertically extending member 107 having a horizontally extending flange 108 at the top thereof, which flange 108 extends inwardly toward the center of the carriage 70.

A hollow drum 110 has a bowl shaped body 111 with an arcuate wall 112 terminating in an upstanding rectangular top plan view neck 113. A cover 115 is constructed and arranged to fit snugly over the neck 113 to seal the drum 110. The sides 114 of the drum are slightly arcuate, see FIG. 3, and have extending outwardly therefrom mounting stubs 116, which stubs in cooperation with spaced apart grommets 117 on the outer ends thereof to mount the drum 110 to the carriage 70. Specifically, each of the stubs 116 having the spaced apart grommets 117 thereon fits within the notch 85 in the associated carriage side wall 77. The grommets 117 are retained on the mounting stubs 116 by means of a washer 119 and fastener 118, as best seen in FIGS. 2 and 4.

Location of the mounting stubs 116 is critical to the operation of the present invention. It has been found that if the drum 110 is mounted to the carriage 70 at the rear of the drum 110, little or no mixing or polishing action is provided. Similarly, if the drum 110 is mounted to the carriage 70 at the top of the drum, little or no mixing or polishing action is provided. It is necessary that the drum 110 be pivotally mounted to the carriage 70 in the upper righthand quadrant of the drum body 111 as seen in FIG. 4. The pivotal mounting of the drum 110 to the carriage 70 by means of the mounting stubs 116 cooperating with the notches 85 and the location of the stubs 116 in the upper rearward quadrant of the drum body is critical to the efficient operation of the present invention to provide the mixing necessary inside the drum to accomplish the intended purpose of the present invention in a superior manner.

The drum 110 is further provided with a pair of fingers 120 extending outwardly from the front of the drum with each finger having a strength improving web 121 extending rearwardly and downwardly from the distal end of the finger to the drum body. The fingers 120 are spaced apart a predetermined distance and extend outwardly a sufficient extent to overlie the horizontal flange 108 of the crank 106. A threaded fastener 125 having an enlarged head 127 extends downwardly between the fingers 120 and with grommets 126 and 127 positioned above and below the fingers 120 threadably engages the flange 108 and the threaded aperture therein to connect the fingers 120 and hence the drum 110 to the crank 106. Tightening the threaded fastener 125 securely connects the fingers 120 to the crank 106. The grommets 126 and 127 prevent unwanted noise, yet transmit the necessary vibration during subsequent reciprocal movement of the crank 106, as hereinafter set forth.

As seen, the drum 110 is easily removed from the carriage 70 by loosening the fasteners 118 and the fastener 125. This ease of removal facilitates cleaning the drum 110 or substituting alternative drums. Installing a particular drum 110 for operation is relatively easy and requires only the tightening of fasteners 118 and connecting the fingers 120 to the crank 106 by the fastener 125. Thereafter, actuation of the motor 95 results in rotation of the output shaft 96 and due to the eccentric mounting of the collar 105 up and down reciprocating movement of the crank 106. The coaction of the up and down movement of the front end of the drum 110 at the fingers 120 with the pivotally fixed mounting of the rear end of the drum to the carriage 70 at the stubs 116 causes the material inside the drum to move rearwardly and upwardly along the arcuate back wall of the drum and thereafter to fall forwardly toward the center of the drum thereby ensuring good mixing and polishing action.

The device 50 is relatively inexpensive to manufacture as compared with other devices such as that disclosed in the Smith patent, while at the same time due to the superior insulation of the drum 110 from the carriage 70 and the carriage from the base 55, the device is extremely quiet during operation and produces no unwanted vibration. Superior polishing action is also produced by the subject invention and in fact polishes materials faster than heretofore available in this type of equipment.

Summarizing, the pivotal mounting of the drum 110 directly to the carriage 70 in combination with the reciprocating movement of the other end of the drum connected via the crank 106 to the motor output shaft 96, results in superior circulation and agitation of the materials in the drum producing superior polishing action. The position of the drum mounting stubs 116 in the upper rear quadrant of the drum 110 is critical to the superior performance of the device 50. The neck 113 of the drum 110 in combination with the unique circular mixing action of the device permits operation of the device without the cover 115 without spilling the liquid material inside the drum.

While there has been described what is at present considered to be the preferred embodiment of the present invention, it will be understood that various modifications and alterations may be made therein without departing from the true spirit and scope of the present invention and it is intended to cover in the appended claims all such modifications and alterations.

I claim:

1. A vibratory polishing machine for minerals, gem stones and the like comprising a base, a carriage resiliently mounted within said base, a motor fixedly mounted on said carriage and having an output shaft extending therefrom, a drum having sidewalls and rounded front and rear end walls, said drum sidewalls being pivotally mounted directly to said carriage above the mid point of the sidewalls and near the rear end wall of said drum, and means eccentrically mounted to said output shaft connecting the front end wall of said drum to said out shaft, whereby actuation of said motor causes said output shaft to rotate and said front end of said drum to vibrate vertically while the rear end of said drum remains substantially stationary, the rapid reciprocating vertical movement of said front end of said drum causing minerals, gem stones or the like in said drum to move upwardly along the wall at the rear end and then to fall inwardly toward the middle of said rum providing a polishing action.

2. The vibratory polishing machine set forth in claim 1, wherein said drum body is rounded to promote the polishing action of the minerals, gem stones or the like contained therein.

3. The vibratory polishing machine set forth in claim 2, wherein said drum is provided with an upstanding neck to permit the drum to remain uncovered during operation of said machine without the material inside said drum spilling.

4. The vibratory polishing machine set forth in claim 1, wherein resilient insulation is provided between said drum and said carriage at the mounting means therebetween.

5. The vibratory polishing machine set forth in claim 1, wherein said drum is mounted to said carriage above the connection of said drum to said output shaft.

6. The vibratory polishing machine set forth in claim 1, wherein said means eccentrically mounting said drum to said output shaft include a pair of spaced apart collars eccentrically mounted to said output shaft and a crank fixedly mounted between said collars, said crank being connected to the other end of said drum.

7. The vibratory polishing machine set forth in claim 6, wherein said crank has a horizontally extending flange at the top thereof having a threaded aperture therein, said drum has a pair of fingers extending outwardly from the other end thereof overlying said aperture, and a threaded fastener extends between said fingers and into said aperture fixedly connecting said drum to said output shaft.

8. The vibratory polishing machine set forth in claim 1, wherein said carriage is spring mounted to said base.

* * * * *